United States Patent [19]

Ishibashi et al.

[11] 4,144,068

[45] Mar. 13, 1979

[54] METHOD FOR COLOR PHOTOGRAPHIC PROCESSING

[75] Inventors: Hiroshi Ishibashi; Nobuo Sakai; Kiyoshi Imai; Junya Nakajima, all of Minami-ashigara, Japan

[73] Assignee: Fuji Photo Film Co., Ltd., Minami-ashigara, Japan

[21] Appl. No.: 873,750

[22] Filed: Jan. 30, 1978

[30] Foreign Application Priority Data

Jan. 28, 1977 [JP] Japan ..... 52-8521

[51] Int. Cl.[2] ..... G03C 5/50; G03C 5/32

[52] U.S. Cl. ..... 96/60 R; 96/59; 96/60 BF; 96/22

[58] Field of Search ..... 96/107, 109, 60 R, 60 BF, 96/22

[56] References Cited

U.S. PATENT DOCUMENTS

| | | | |
|---|---|---|---|
| 2,952,539 | 9/1960 | Dersch et al. | 96/109 |
| 2,981,624 | 4/1961 | Dersch et al. | 96/109 |
| 3,042,521 | 7/1962 | Dersch et al. | 96/109 |
| 3,220,839 | 11/1965 | Herz et al. | 96/109 |
| 3,767,401 | 10/1973 | Newman et al. | 96/60 BF |
| 3,879,202 | 4/1975 | Yamaguchi | 96/60 BF |
| 3,940,271 | 2/1976 | Kawai et al. | 96/60 BF |
| 3,964,905 | 6/1976 | Hirose et al. | 96/60 R |
| 4,075,021 | 2/1978 | Kikuchi et al. | 96/60 R |

*Primary Examiner*—Mary F. Kelley

*Attorney, Agent, or Firm*—Sughrue, Rothwell, Mion, Zinn and Macpeak

[57] ABSTRACT

In a method of processing an image-wise exposed silver halide color photographic material by applying thereto at least a color development processing and a silver removal processing (including performing a bleaching and a fixing separately or simultaneously, (e.g., a blixing)), the improvement which comprises processing, after the color development processing, the silver halide color photographic material with a processing bath containing a compound, as a bleach accelerator, represented by the following general formula (I):

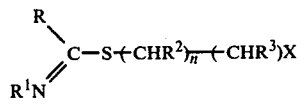

(I)

wherein R represents an $—NR^4R^5$ group, an $—O—R^6$ group or an $—S—R^6$ group; $R^6$ represents an atomic group necessary for forming a ring together with $R^1$; $R^1$, $R^4$ and $R^5$, which may be the same or different, each represents a hydrogen atom or an alkyl group; $R^2$ and $R^3$, which may be the same or different, each represents a hydrogen atom or a methyl group; n represents 1 or 2; X represents an amino group, a hydroxyl group, a $—COO(M)_m$ group or an $—SO_3(M)_m$ group; M represents a cation rendering the compound water soluble; and m represents 0 or 1 and is 0 when the compound forms an inner salt; the nitrogen atom bound to $R^1$ may be quaternized with the charge of the quaternized nitrogen atom being neutralized by an acid group and $R^1$ may form a ring together with $R^4$ or $R^5$; with the processing bath being used prior to or as a bleach bath or a blix bath, each containing a ferric ion complex as a bleaching agent.

9 Claims, No Drawings

METHOD FOR COLOR PHOTOGRAPHIC PROCESSING

BACKGROUND OF THE INVENTION

1. Field of the Invention

The present invention relates to a method of processing color photographic materials (particularly, reversal color photographic materials) and, more particularly, it relates to an improvement in a method for color photographic processing using a novel bleach accelerator.

2. Description of the Prior Art

In general, the fundamental processing steps for silver halide color photographic materials include a color development step and a silver removal step. That is, when an image-wise exposed silver halide color photographic material is processed in a color development step, the silver halide is reduced by a color developing agent to form silver and the oxidized color developing agent reacts with color formers to provide dye images. Thereafter, the color photographic material is processed in a silver removal step, whereby the silver formed in the previous step is oxidized by the action of an oxidizing agent (usually called a "bleaching agent"), dissolved by a complexing agent for silver ion usually called a "fixing agent", and removed from the photographic material. Thus, only dye images remain on the photographic material. When development for color photographic materials is practiced, auxiliary processing steps are, if desired, employed in addition to the above-described color development step and silver removal step for maintaining good photographic and physical qualities of the dye images. For example, a hardening bath for preventing light-sensitive layers from being excessively softened during processing, a stop bath for effectively stopping the development reaction, an image stabilization bath for stabilizing the dye images formed, and a bath for removing the backing layer of a support are used.

Furthermore, the above-described silver-removal step can be performed in one step using a blix bath containing the combination of a bleaching agent and a fixing agent and in two steps using a bleaching bath and a fixing bath.

In general, potassium ferricyanide is used in the bleach bath as an oxidizing agent. However, a bleach bath using potassium ferricyanide has the disadvantages that the bleach bath must be, when fatigued, exchanged for fresh bleach bath and also the ferricyanide ions and ferrocyanide ions, which are the reduced form of ferricyanide ions, present in water, which must be discharged by overflow during processing or by water washing after bleaching form cyan compounds by photochemical oxidation. These cyan compounds are very toxic and, thus, give rise to serious problems. Therefore, the development of a bleaching agent which can be used as a substitute for potassium ferricyanide has been desired.

On the other hand, bleaching agents other than potassium ferricyanide, potassium dichromate, ferric ion complexes, persulfates, quinones, copper salts, etc., have hitherto been used but they have the disadvantages that the oxidizing capability is weak and the treatment thereof is troublesome.

Ferric ion complexes are sometimes used as a bleaching agent in a blix bath for color photographic papers (as disclosed in, for example, German Pat. Nos. 866,605 and 966,410 and British Pat. Nos. 746,567, 933,088 and 1,014,396). However, since a blix bath containing such a ferric ion complex shows a weak oxidative capability, a blix bath is rarely used for processing high-sensitive silver halide photographic materials, in particular, in-camera type color photographic materials using silver iodobromide.

Also, as the case may be, the ferric ion complex may be added to a bleach bath together with a bromide. However, a long time is required for a bleach bath containing a ferric ion complex as a bleaching agent for bleaching to be performed due to the weak oxidative capability of such a bleach bath as in the case of a blix bath.

Recently, from the standpoint of simplifying the processing for color photographic materials and preventing environmental pollution, a bleaching process using mainly a complex salt of ferric ion and an aminopolycarboxylic acid, such as, for example, an iron (III)-ethylenediaminetetraacetic acid complex, has been mostly used. However, a bleach bath or blix bath containing an iron (III) complex of this kind has the disadvantage that a long period of time for bleaching is required due to the weak oxidative capability of the iron (III) complex.

Therefore, to increase the oxidative capability of a bleach bath or blix bath containing a bleaching agent of this kind to decrease the period of time required for bleaching, various bleach accelerators have hitherto been proposed as disclosed in, for example, U.S. Pat. No. 3,893,858, British Pat. No. 1,337,346 and Czechoslovakian Pat. No. 134,864.

However, some of these accelerators have a poor accelerating action in a blix bath and the accelerators which have satisfactory characteristics when they are added to any of a bleach bath, a blix bath or a pre-bath (that is, a bath employed between a color development bath and a bleach bath or blix bath) are rare.

SUMMARY OF THE INVENTION

An object of this invention is to provide a novel bleach accelerator which has a high bleach accelerating action and can be incorporated in a bleach bath, a blix bath or a pre-bath without adversely influencing the photographic characteristics.

Another object of this invention is to provide a method for color photographic processing using such a novel bleach accelerator.

Still a further object of this invention is to provide a method of increasing the bleaching capability of a bleach bath or a blix bath containing a ferric ion complex as a bleaching agent.

A further object of this invention is to provide a method of rapidly bleaching or blixing color photographic materials having camera exposure sensitivity.

As a result of various investigations, it has now been discovered that the above-described objects are effectively attained by incorporating a compound represented by the following general formula (I) in a bleach bath or a blix bath containing a ferric ion complex, or a pre-bath:

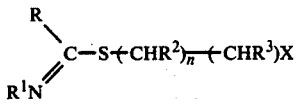

(I)

wherein R represents an —$NR^4R^5$ group, an —O—$R^6$ group or an —S—$R^6$ group; $R^6$ represents an atomic group necessary for forming a ring together with $R^1$; $R^1$, $R^4$ and $R^5$, which may be the same or different, each represents a hydrogen atom or an alkyl group; $R^2$ and $R^3$, which may be the same or different, each represents a hydrogen atom or a methyl group; n represents 0, 1 or 2; X represents an amino group, a hydroxyl group, a $—COO(M)_m$ group, or an $—SO_3(M)_m$ group; M represents a cation rendering the compound water soluble; and m represents 0 or 1 and is 0 when the compound forms an inner salt; the nitrogen atom bound to $R^1$ may be quaternized with the charge of the quaternized nitrogen atom being neutralized by an acid group, and $R^1$ may form a ring together with $R^4$ or $R^5$.

Thus, the invention provides a method of processing an image-wise exposed silver halide color photographic material by color development processing and silver removing processing (including bleaching and fixing separately or simultaneously which comprises processing the silver halide color photographic material, after color development processing, with a processing bath containing the compound represented by the general formula (I) described above, the processing bath being used as a bleach bath or a blix bath containing a ferric ion complex or prior to a bleach bath or a blix bath containing a ferric ion complex.

DETAILED DESCRIPTION OF THE INVENTION

In the general formula (I) indicated above, it is preferred for the number of carbon atoms in the $—(CHR^2)_n(CHR^3)—$ moiety to be 3 or less. Compounds of this type have the general formula (II):

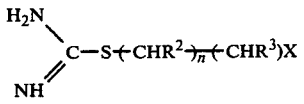

(II)

wherein $R^2$, $R^3$, and n each have the same significance as in the general formula (I), wherein the number of carbon atoms of the $—(CHR^2)_n(CHR^3)—$ moiety is 3 or less; X represents a hydroxyl group, a $—COO(M)_m$ group or an $—SO(M)_m$ group; and M and m each have the same significance as in the general formula (I). Also, as described above in regard to the general formula (I), the nitrogen atom bound to $R^1$ may be quaternized and examples of the substituents bound to the nitrogen atom when quaternized are hydrogen atoms, alkyl groups, e.g., having 1 to 7 carbon atoms, preferably 1 to 3 carbon atoms, such as a methyl group, an ethyl group, etc. Suitable examples of alkyl groups for $R^1$, $R^4$ and $R^5$ are lower alkyl groups having 1 to 8 carbon atoms such as unsubstituted alkyl groups, e.g., a methyl group, an ethyl group, a butyl group, a hexyl group and an octyl group and substituted alkyl groups having 1 to 8 carbon atoms in the alkyl moiety and substituted with a halogen atom (e.g., a chlorine atom, a bromine atom, etc.), a hydroxy group, a carboxy group, an alkoxycarbonyl group in which the alkoxy moiety has 1 to 8 carbon atoms (e.g., methoxycarbonyl, ethoxycarbonyl, etc.), an amino group, which may be unsubstituted or substituted (e.g., alkylamino in which the alkyl moiety contains 1 to 8 carbon atoms, dialkylamino in which each alkyl moiety contains 1 to 8 carbon atoms, acylamino, etc.), a sulfo group, an alkoxy group having 1 to 8 carbon atoms in the alkoxy moiety thereof (e.g., methoxy, ethoxy, butoxy, etc.), an alkylthio group having 1 to 8 carbon atoms in the alkyl moiety thereof (e.g., methylthio, ethylthio, etc.), etc. Also, examples of rings formed by $R^1$ and one of $R^4$ and $R^5$ or rings formed by $R^1$ and $R^6$ are 5-membered or 6-membered heterocyclic rings including one or more of a nitrogen atom, an oxygen atom, or a sulfur atom as hetero atoms and further the heterocyclic ring may be condensed with an aromatic ring such as, for example, a benzene ring. An example of an uncondensed ring is a 2-imidazoline ring and examples of condensed rings are a benzimidazole ring, a benzothiazole ring and a benzoxazole ring.

Suitable examples of cations for M include $H^+$, $Na^+$, $K^+$, $Li^+$, $NH_4^+$, etc. Ammonium groups substituted with an alkyl group having 1 to 8 carbon atoms, preferably a methyl group and an ethyl group, are also suitable for M.

X represents an unsubstituted amino group or a substituted amino group such as an amino group substituted with one or two alkyl groups having 1 to 8 carbon atoms or an acylamino group. Suitable examples of substituted amino groups are a methylamino group, a dimethylamino group, an ethylamino group and a diethylamino group.

Suitable examples of acids which can neutralize the plus charge on the quaternary nitrogen atom are hydrochloric acid, hydrobromic acid, sulfuric acid, nitric acid and oxalic acid.

The compounds of the general formula (I) and the methods of preparing these compounds are described in, for example, U.S. Pat. Nos. 3,535,115, 3,301,678 and 3,220,839 and Thomas P. Johnston & Carl R. Stringfellow, Jr., *Journal of Medical Chemistry,* Vol. 9(6), 921–924(1966) and further the compounds of the general formula which are not described specifically therein can be easily prepared according to the methods as described therein. For example, compounds (1) to (7) and (15) to (18) specifically described below can be prepared using the methods described in the above-indicated U.S. patents and compounds (8) to (14) and (19) can be prepared using the methods described in Johnston and Stringfellow, supra, or further they may be easily prepared according to these methods.

Specific examples of the compounds represented by the general formula (I) described above are shown below:

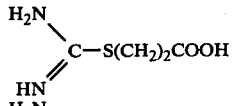

(1)

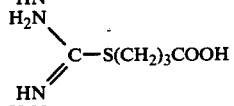

(2)

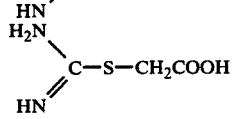

(3)

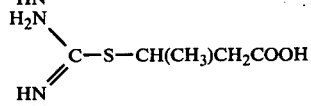

(4)

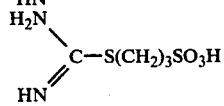

(5)

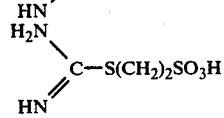

(6)

-continued (7) 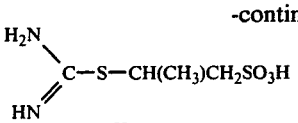

(8) 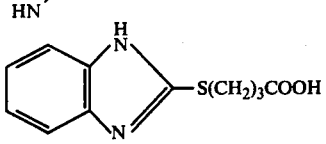

(9) 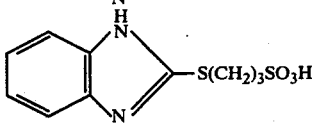

(10) 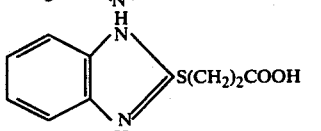

(11) 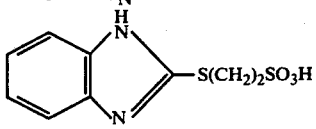

(12) 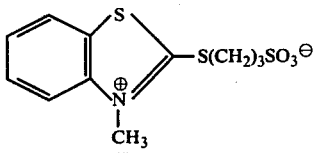

(13) 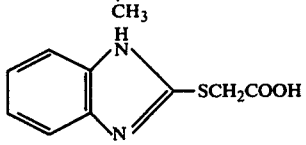

(14) 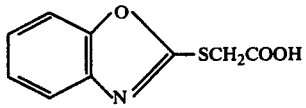

(15) 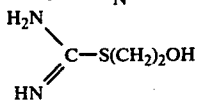

(16) 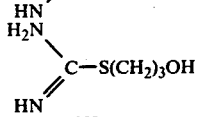

(17) 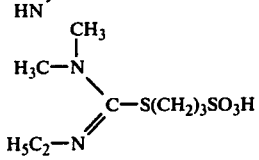

(18) 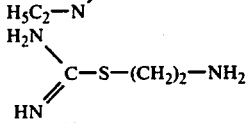

(19) 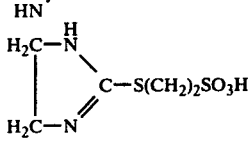

Compounds (1) to (11), compound (13), compound (14) and compound (17) may form inner salts or may be in the form of the alkali metal salts or the ammonium salts thereof.

Among the compounds indicated above, compounds (1), (8), (10), (12) and (15) are preferred and, in particular, compounds (8), (10) and (11) are preferably used in a bleach bath, compounds (1), (2), (3), (7) and (15) are preferably used in a blix bath and compounds (1), (2), (4), (5), (6), (8), (10), (12) and (15) are preferably used in a pre-bath since in such cases an excellent bleach accelerating effect is obtained.

It is preferred to use an organic compound, in particular, an aminopolycarboxylic acid, an aminopolysulfonic acid or the salts thereof as the ligand in the ferric ion complex used as the bleaching agent. Furthermore, it is especially preferred to use an aminopolycarboxylic acid or the salt thereof as the ligand since they are inexpensive and less danger of pollution occurs.

Suitable bases for forming the salt of the aminopolycarboxylic acid or aminopolysulfonic acid include, for example, alkali metal hydroxides, ammonia, water-soluble amines, etc. Examples of suitable alkali metals are sodium, potassium, lithium, etc., and examples of suitable water-soluble amines are alkylamines such as diethylamine, triethylamine, butylamine, etc., alicyclic amines such as cyclohexylamine, etc., arylamines such as aniline, m-toluidine, etc., and heterocyclic amines such as pyridine, morpholine, piperidine, etc.

Examples of aminopolycarboxylic acids, aminopolysulfonic acids and the salts thereof which can be used are ethylenediaminetetraacetic acids (e.g., ethylenediaminetetraacetic acid and the disodium salt, diammonium salt, tetra-(trimethylammonium) salt, tetrapotassium salt, tetrasodium salt, trisodium salt, etc., thereof), diethylenetriaminepentaacetic acids (e.g., diethylenetriaminepentaacetic acid and the pentasodium salt, etc., thereof), ethylenediamine-N-($\beta$-oxyethyl)-N,N',N'-triacetic acids (e.g., the triacetic acid and the trisodium salt, triammonium salt, etc., thereof), propylenediaminetetraacetic acids (e.g., the tetraacetic acid and the disodium salt thereof), nitrilotriacetic acids (the acid and the trisodium salt, etc., thereof), cyclohexanediaminetetraacetic acids (e.g., the acid and the disodium salt, etc., thereof), iminodiacetic acids, dihydroxyethylglycines, ethyl ether diaminetetraacetic acids, glycol ether diaminetetraacetic acids, ethylenediaminetetrapropionic acids, phenylenediaminetetraacetic acids, 1,3-diaminopropanol-N,N,N',N'-tetramethylenesulfonic acids, ethylenediamine-N,N,N',N'-tetramethylenesulfonic acids, 1,3-propylenediamine-N,N,N',N'-tetramethylenesulfonic acids, and the like.

The ferric ion complex used in this invention may be added to the bleach bath in the form of a complex or the ferric ion complex may be formed in the bleach bath using a ferric salt such as ferric sulfate, ferric chloride, ferric nitrate, ferric ammonium sulfate, ferric phosphate, etc., and a chelating agent such as an aminopolycarboxylic acid and an aminopolysulfonic acid.

Where the addition is in the form of the complex, a single ferric complex may be used or two or more ferric complexes may be used. On the other hand, in forming the ferric complex in a bleach bath using a ferric salt and a chelating agent, one or more ferric salts may be used. Also, in all cases, the amount of the chelating agent used may be larger than the amount necessary for forming the ferric ion complex.

The bleach bath used in this invention preferably contains a halide (for example, a bromide, chloride, iodide, etc., of ammonia or of an alkali metal such as sodium and potassium and a bromide is particularly preferred) in addition to the ferric ion complex and the bleach accelerator described above. A suitable amount of the halide used in this case is about 50 to about 300 g per liter of the bleach bath.

The bleach bath used in this invention may further contain one or more inorganic acids, organic acids or the salts thereof having a pH buffering capability, such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., and further a sulfite (for example, sodium sulfite, potassium sulfite, ammonium sulfite, etc.).

In this case, the amount of the ferric ion complex used is about 0.1 to about 2 mols per liter of the bleach bath. It is desirable for the pH of the bleach bath at use to be about 3.0 to about 8.0, in particular, 4.0 to 7.0.

The amount of the bleach accelerator of this invention can be appropriately selected depending on the kind of bleach accelerator compound used and the kind of photographic material to which the photographic process of this invention is applied. A suitable concentration of the bleach accelerator used is, for example, about $2 \times 10^{-6}$ mol to about $10^{-1}$ mol per liter of the solution used, but preferably is in the range of $1 \times 10^{-4}$ to $5 \times 10^{-2}$ mol per liter.

On the other hand, when the compound of this invention is employed in a blix bath, the blix bath can contain a conventional fixing agent, that is, a thiosulfate such as sodium thiosulfate, ammonium thiosulfate, ammonium sodium thiosulfate, potassium thiosulfate, etc.; a thiocyanate such as sodium thiocyanate, ammonium thiocyanate, potassium thiocyanate, etc.; and a water-soluble silver halide solvent such as ethylenebisglycolic acid, 3,6-dithia-1,8-octanediol. They may be used individually or as a mixture thereof.

The amount of each component in the blix bath is, for example, as follows: the amount of the ferric ion complex is about 0.1 to 2 mols per liter of the blix bath and the amount of the fixing agent is about 0.2 to 4 mols per liter of the blix bath.

The blix bath used in this invention may further contain additives which can be added to the bleach bath as indicated above and also a sulfite such as, for example, sodium sulfite, potassium sulfite, ammonium sulfite, etc. Moreover, the blix bath may also contain a blix accelerator, for example, the polyamine compounds as described in Japanese Patent Publication No. 8836/'70, the thiourea derivatives as described in Japanese Patent Publication No. 8506/'70, the iodides as described in German Pat. No. 1,127,715, the polyethylene oxides as described in German Pat. No. 966,410, the nitrogen-containing heterocyclic compounds as described in German Pat. No. 1,290,812, and other thioureas. These compounds may be employed individually or as a mixture thereof. Also, the pH of the blix bath usually is about 4.0 to about 8.0, more preferably 5.0 to 7.0. Furthermore, the pH of the pre-bath used in this invention is usually about 3.0 to about 7.0, preferably 5.5 to 6.5.

The process of this invention is applicable to all silver halide color photographic materials, for example, color photographic papers, color photographic negative films, color photographic reversal films, color photographic positive films, etc., for increasing the silver removal accelerating effect but, in particular, a marked effect is obtained when the process of this invention is applied to the processing of color photographic reversal materials. That is, when the bleach accelerator of this invention is used, bleaching of silver can be sufficiently achieved in a shortened period of time.

There is no particular restriction on the amount of iodide in the silver iodobromide contained in the color photographic materials described above but the amount of iodide is preferably from about 1 to about 8 mol%, in particular, from about 3 to about 7 mol%.

The processing of color photographic reversal materials can be usually performed, for example, in the order of black and white development → stop → wash → fogging → wash → color development → stop → (hardening) → wash → bleach → wash → fix → wash → stabilization → drying. A pre-bath, a prehardening bath, and a neutralization bath may also be employed, if desired. Furthermore, the stabilization bath and the wash steps before and after the bleach may be omitted. The fogging bath can be replaced by a re-exposure (an overall exposure) or the fogging bath can be omitted by adding a fogging agent such as t-butylamineborane, sodium borohydride, etc., to the color developer. Alternatively, the color development may be performed after fogging using a single bath containing t-butyl-amineborane, sodium borohydride, or an $Sn^{2+}$ complex. Suitable complexing agents for the $Sn^{2+}$ complexes which can be used, for example, are the compounds as described in British Pat. No. 1,298,752, Japanese Patent Application (OPI) No. 36,835/'71, Japanese Patent Publication No. 25,959/'71, German Patent Application (OLS) No. 2,111,813, and Japanese Patent Application Nos. 84,322/'76, 94,374/'76, 100,972/'76 and 94,375/'76. Specific examples of these complexing agents are phosphonic acid, aminopolycarboxylic acid, citric acid, sodium citrate, lactic acid, tartaric acid, pyrophosphoric acid, condensed phosphates (e.g., tetrapolyphosphate, hexametaphosphate, etc.), organic phosphates, phosphonocarboxylic acids and the like.

The processing temperature usually ranges from about 20° C. to about 70° C. and preferably from about 30° C. to 60° C.

The photographic system for the color photographic materials, in particular reversal color photographic materials, suitable for processing may be a system wherein couplers are incorporated in the photographic materials or a system wherein couplers are present in the color developers. That is, the process of this invention can be advantageously applied to any types of reversal color photographic materials.

Conventional color developers, black and white developers (for processing reversal color photographic materials), stop baths, fix baths, etc., can be employed in the process of this invention.

For example, a typical example of a color developer for reversal color photographic materials is illustrated in the examples of this invention and the color developer may further contain other additives such as, for example, ethylenediamine. Other suitable color developing agents which can be used are described in U.S. Pat. Nos. 3,698,525, 3,656,950 and 3,816,134 and *J.A.C.S.*, Vol. 73, page 3100 (1951). Suitable color developing processes which can be used are described in U.S. Pat. Nos. 4,040,835 and 4,032,346.

Furthermore, silver halide photographic materials, other hydrophilic colloids, the process of producing them, and photographic additives which can be also used for color photographic materials processed using the color photographic process of this invention are described in *Research Disclosure*, No. 92, pages 107–110 (December 1971).

The following examples are given to illustrate the present invention in greater detail. Unless otherwise indicated herein, all parts, percents, ratios and the like are by weight.

EXAMPLE 1

A color photographic film was prepared by coating in succession on a cellulose triacetate film support a red-sensitive silver iodobromide emulsion (AgI: 7 mol%) containing 1-hydroxy-4-chloro-2-n-dodecylnaphthamide as a cyan coupler, a green-sensitive silver iodobromide emulsion (AgI: 6 mol%) containing 1-(2',4',6'-trichlorophenyl)-3-[3''-(2''',4'''-di-t-amylphenoxyacetamido)benzamido]-5-pyrazolone as a magenta coupler and a blue-sensitive silver iodobromide emulsion (AgI: 6 mol%) containing α-pivaloyl-2-chloro-5-[γ-(2,4-di-t-amylphenoxy)butyramido]acetanilide as a yellow coupler.

Each coupler described above was emulsified and incorporated in each silver halide photographic emulsion using dibutyl phthalate and tricresyl phosphate as the coupler solvent, and sorbitan monolaurate and sodium dodecylbenzenesulfonate as the emulsifying agent. Furthermore, the lauric acid ester of sucrose and sodium 1-(p-nonylphenoxytrioxyethylene)butane-4-sulfonate were added to each silver halide emulsion as a coating aid.

The photographic film thus prepared also included a filter layer composed of yellow colloidal silver between the green-sensitive silver halide emulsion layer and the blue-sensitive silver halide emulsion layer, an interlayer of gelatin with di-t-amylhydroquinone dispersed therein between the green-sensitive silver halide emulsion layer and the red-sensitive silver halide emulsion layer, and a protective layer mainly composed of gelatin on the blue-sensitive silver halide emulsion layer.

The coverage of silver was 1.5 g/m$^2$ in the red-sensitive silver halide emulsion layer, 1.5 g/m$^2$ in the green-sensitive silver halide emulsion layer and 0.9 g/m$^2$ in the blue-sensitive silver halide emulsion layer.

Also, the silver/coupler molar ratio in each silver halide emulsion layer was 8.0 in the red-sensitive emulsion layer, 9.5 in the green-sensitive emulsion layer, and 8.0 in the blue-sensitive emulsion layer.

The photographic film was exposed through an optical wedge to a tungsten lamp for 1/100 second and then processed using the following reversal process, with each step being at 37° C.

| Processing | Time |
|---|---|
| First Development (black and white) | 3 min |
| Stop | 2 min |
| Wash | 2 min |
| Color Development (containing fogging agent) | 6 min |
| Stop | 2 min |
| Wash | 2 min |
| Bleach | 6 min |
| Wash | 2 min |
| Fix | 2 min |
| Wash | 2 min |
| Stabilization | 30 sec |
| Drying | |

The processing solutions used in the above reversal process had the following composition.

| | | |
|---|---|---|
| First Developer (black and white) | | |
| Sodium Sulfite | 60.0 | g |
| 1-Phenyl-3-pyrazolidone | 0.3 | g |
| Hydroquinone | 5.0 | g |
| Sodium Carbonate (monohydrate) | 41.0 | g |
| Potassium Bromide | 2.0 | g |
| Potassium Iodide (1% aq. soln.) | 1.0 | ml |
| Potassium Thiocyanate (1N aq. soln.) | 10.0 | ml |
| Sodium Hydroxide (10% aq. soln.) | 2.0 | ml |

-continued

| | | |
|---|---|---|
| Water to make | 1.0 | l |
| Stop Bath | | |
| Sodium Acetate | 30 | g |
| Glacial Acetic Acid | 8 | ml |
| Water to make | 1 | l |
| Color Developer | | |
| Benzyl Alcohol | 5.0 | ml |
| Sodium Hydroxide | 0.5 | g |
| Diethylene Glycol | 3.0 | ml |
| Sodium Hexametaphosphate | 2.0 | g |
| Sodium Sulfite | 2.0 | g |
| Potassium Bromide | 2.0 | g |
| 4-Amino-3-methyl-N-ethyl-N-β-hydroxyethyl)aniline Sesquisulfate (monohydrate) | 10.0 | g |
| Citrazinic Acid | 0.4 | g |
| Metaboric Acid | 0.5 | g |
| Sodium Metaborate (tetrahydrate) | 77.0 | g |
| Sodium Borohydride | 0.1 | g |
| Water to make | 1.0 | l |
| Bleach Bath | | |
| Sodium Iron (III) Ethylenediaminetetraacetate (dihydrate) | 100.0 | g |
| Ammonium Bromide | 150.0 | g |
| Sodium Ethylenediaminetetraacetate | 5.0 | g |
| Boric Acid | 3.1 | g |
| Borax | 1.5 | g |
| Water to make | 1 | l |
| Fix Bath | | |
| Sodium Thiosulfate | 150 | g |
| Sodium Sulfite | 15 | g |
| Borax | 12 | g |
| Glacial Acetic Acid | 15 | ml |
| Potassium Alum | 20 | g |
| Water to make | 1 | l |
| Stabilization Bath | | |
| Formaldehyde (37% by weight) | 10 | ml |
| Fuji Dry Well (trade name for a surface active agent composition produced by the Fuji Photo Film Co., Ltd.) | 5 | ml |
| Water to make | 1 | l |

In the above process, the bleaching step was carried out for 6 minutes using the above-described bleach bath or a bleach bath of the same composition containing additionally 1 g/liter of the bleach accelerator of this invention. After processing, the amount of silver remaining in the photographic film (at the maximum density area and the minimum density area) was measured using fluorescent X-ray analysis. The results are shown in Table 1 below.

TABLE 1

| Bleach Bath | Bleach Accelerator | Amount of Silver (μg/cm$^2$) Maximum Density Area | Minimum Density Area |
|---|---|---|---|
| A-1 | None | 17.2 | 14.0 |
| B-1 | (3)* | 13.2 | 7.2 |
| C-1 | (5) | 12.7 | 7.5 |
| D-1 | (6) | 13.0 | 7.2 |
| E-1 | (8) | 7.0 | 5.5 |
| F-1 | (10) | 6.9 | 5.6 |
| G-1 | (12) | 6.0 | 5.0 |

(*):Compound of this invention described herein before.

As is clear from the above results, when Bleach Baths (B-1) to (G-1) containing the bleach accelerators of this invention were used, the silver removal was accelerated as compared with Comparison Bleach Bath (A-1) which did not contain the bleach accelerator of this invention.

EXAMPLE 2

The same procedures as described in Example 1 were repeated except that no bleach accelerator of this invention was incorporated in the bleach bath and a pre-bath containing 1 g/liter of the bleach accelerator of this invention or a pre-bath which did not contain the bleach accelerator was used for 2 minutes in place of the second stop bath used in Example 1. The composition of the pre-bath used was as follows:

| Pre-bath Composition | |
|---|---|
| Sodium Acetate | 20 g |
| Bleach Accelerator of this Invention | 1 g |
| Glacial Acetic Acid (amount necessary for adjusting the pH of the pre-bath to 5.5 ± 0.2) | |
| Water to make | 1 l |

After processing, the amount of silver remaining in the photographic film was measured in the same manner as in Example 1. The results obtained are shown in Table 2 below.

TABLE 2

| Pre-bath | Bleach Accelerator | Amount of Silver ($\mu g/cm^2$) Maximum Density Area | Minimum Density Area |
|---|---|---|---|
| A-2 | None | 18.1 | 14.2 |
| B-2 | (1) | 5.8 | 4.9 |
| C-2 | (2) | 5.9 | 5.0 |
| D-2 | (4) | 5.4 | 5.0 |
| E-2 | (5) | 6.9 | 4.9 |
| F-2 | (8) | 6.9 | 4.8 |
| G-2 | (10) | 6.5 | 5.1 |
| H-2 | (11) | 7.0 | 5.1 |
| I-2 | (12) | 6.8 | 4.9 |
| J-2 | (15) | 5.8 | 5.1 |

As is clear from the above results, when Pre-baths (B-2) to (J-2) containing the bleach accelerators of this invention were used, the silver removal was accelerated as compared with Comparison Pre-bath (A-2) which did not contain a bleach accelerator.

EXAMPLE 3

The same procedures as described in Example 1 were repeated except that a blix bath having the composition shown below and containing 1.5 g/liter of the bleach accelerator of this invention as shown in Table 3 below, a blix bath of the same composition but containing 1.5 g/liter of Compound K having the formula:

Compound K

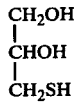

as a comparison bleach accelerator (a typical bleach accelerator described in U.S. Pat. No. 3,893,858), or a blix bath of the same composition without any bleach accelerator was used in place of the bleach bath and the fix bath described in Example 1.

| Blix Bath Composition | | |
|---|---|---|
| Iron (III)-EDTA . 2Na | 120 | g |
| EDTA-2Na | 5 | g |
| $NH_4Br$ | 110 | g |
| $(NH_4)_2S_2O_3$ (70% aq. soln.) | 100 | ml |
| Aqueous Ammonia | 15 | ml |
| $Na_2SO_3$ | 4.5 | g |
| Water to make | 1 | l |

The amount of silver remaining in the photographic film was measured in the same manner as described in Example 1. The results obtained are shown in Table 3 below. The blixing time was 4 minutes or 6 minutes.

TABLE 3

| Blix Bath | Bleach Accelerator | Amount of Silver ($\mu g/cm^2$) Blix Time (4 min) (A) * | (B) ** | Blix Time (6 min) (A) * | (B) ** |
|---|---|---|---|---|---|
| A-3 | None | 19.7 | 15.2 | 18.2 | 13.4 |
| B-3 | Compound K | 19.1 | 15.0 | 16.8 | 11.0 |
| C-3 | (1) | 8.2 | 6.8 | 7.2 | 5.5 |
| D-3 | (2) | 8.4 | 7.0 | 7.5 | 5.9 |
| E-3 | (3) | 6.9 | 6.9 | 7.5 | 5.8 |
| F-3 | (4) | 9.3 | 7.3 | 8.1 | 6.0 |
| G-3 | (5) | 9.2 | 7.2 | 8.8 | 6.9 |
| H-3 | (6) | 10.8 | 9.2 | 8.0 | 5.5 |
| I-3 | (7) | 10.1 | 9.0 | 7.4 | 5.8 |
| J-3 | (8) | 10.8 | 10.1 | 8.8 | 6.3 |
| K-3 | (10) | 10.2 | 9.5 | 9.0 | 6.1 |
| L-3 | (15) | 9.0 | 8.1 | 7.4 | 5.5 |

(*): Maximum density area
(**): Minimum density area

As is clear from the above results, when Blix Baths (C-3) to (L-3) containing the bleach accelerators of this invention were used, the bleaching was accelerated as compared with the use of the blix bath containing Compound K and the blix bath which did not contain a bleach accelerator.

While the invention has been described in detail and with reference to specific embodiments thereof, it will be apparent to one skilled in the art that various changes and modifications can be made therein without departing from the spirit and scope thereof.

What is claimed is:

1. In a method of processing an image-wise exposed silver halide color photographic material by applying thereto a color development processing and a silver removal processing, the improvement which comprises, after the color development processing, processing the silver halide color photographic material with a processing bath containing a compound represented by the following general formula (I) as a bleach accelerator:

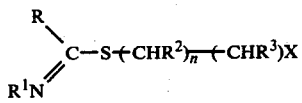

(I)

wherein R represents an $—NR^4R^5$ group, an $—O—R^6$ group or an $—S—R^6$ group; $R^6$ represents an atomic group necessary for forming a ring together with $R^1$; $R^1$, $R^4$ and $R^5$, which may be the same or different, each represents a hydrogen atom or an alkyl group; $R^2$ and $R^3$, which may be the same or different, each represents a hydrogen atom or a methyl group; n represents 0, 1 or 2; X represents an amino group, a hydroxyl group, a $—COO(M)_m$ group or an $—SO_3(M)_m$ group; M represents a cation rendering the compound water soluble; and m represents 0 or 1 and is 0 when the compound forms an inner salt; wherein the nitrogen atom bound to $R^1$ may be quaternized with the charge of the quaternized nitrogen atom being neutralized by an acid group and $R^1$ may form a ring together with $R^4$ or $R^5$, wherein the processing bath is used as a bleach bath or a blix bath, each containing a ferric ion complex as a bleaching agent, or prior thereto.

2. The color photographic processing method as claimed in claim 1, wherein said processing bath containing the bleach accelerator is a bleach bath, a blix bath or another bath used after the color development and prior to the silver removal processing.

3. The color photographic processing method as claimed in claim 1, wherein said ferric ion complex comprises a complex with an aminopolycarboxylic acid as a ligand.

4. The color photographic processing method as claimed in claim 1, wherein said color photographic method is a reversal color photographic method.

5. The color photographic processing method as claimed in claim 1, wherein the silver halide color photographic material comprises a support having thereon at least one silver halide photographic emulsion layer and at least one silver halide emulsion layer comprises a silver iodobromide emulsion.

6. The color photographic processing method as claimed in claim 1, wherein the amount of said bleach accelerator in the processing bath ranges from about $2 \times 10^{-6}$ to about $1 \times 10^{-1}$ mol/liter.

7. The color photographic processing method as claimed in claim 6, wherein the amount of said bleach accelerator ranges from $1 \times 10^{-4}$ to $5 \times 10^{-2}$ mol/-liter.

8. The color photographic processing method as claimed in claim 1, wherein said bleach accelerator is

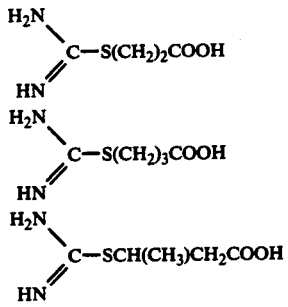

-continued

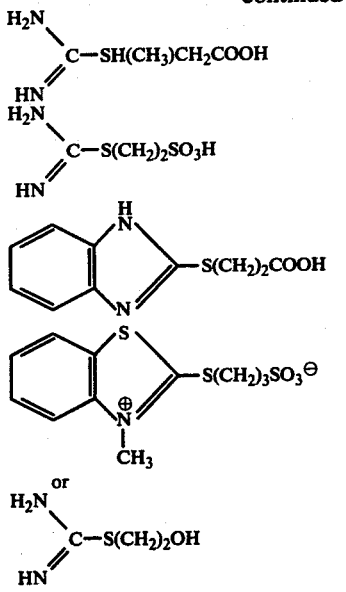

9. The color photographic processing method as claimed in claim 1, wherein said bleach accelerator is a compound represented by the general formula (II):

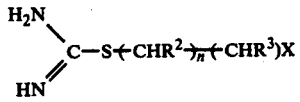

(II)

wherein $R^2$, $R^3$, and n each have the same significance as in the general formula (I), wherein the number of carbon atoms of the $-(CHR^2)_n(CHR^3)-$ moiety is 3 or less; X represents a hydroxyl group, a $-COO(M)_m$ group or an $-SO_3(M)_m$ group; and M and m each have the same significance as in the general formula (I).

* * * * *